United States Patent [19]

Nakamura et al.

[11] Patent Number: 5,000,021

[45] Date of Patent: Mar. 19, 1991

[54] LOAD CONTROL DEVICE FOR USE IN AUTOMATIC FORGING PRESS

[75] Inventors: Masatoshi Nakamura; Tsuguo Wada, both of Osaka, Japan

[73] Assignee: Kurimoto Ltd., Osaka, Japan

[21] Appl. No.: 313,524

[22] Filed: Feb. 22, 1989

[30] Foreign Application Priority Data

Sep. 12, 1988 [JP] Japan ..... 63-228046

[51] Int. Cl.[5] ..... B21D 43/05

[52] U.S. Cl. ..... 72/12; 72/9; 72/405; 72/446

[58] Field of Search ..... 72/405, 446, 447, 9, 72/12; 100/257

[56] References Cited

U.S. PATENT DOCUMENTS

| | | | |
|---|---|---|---|
| 3,785,194 | 1/1974 | Bradlee | 72/405 |
| 3,834,216 | 9/1974 | Schiller et al. | 100/257 |
| 4,148,209 | 4/1979 | Bessino | 72/446 |
| 4,586,365 | 5/1986 | Henkelmann | 72/405 |
| 4,711,169 | 12/1987 | Imanishi et al. | 100/257 |

*Primary Examiner*—Daniel C. Crane

*Attorney, Agent, or Firm*—Jones, Tullar & Cooper

[57] ABSTRACT

In an automatic press for continuously carrying out a plurality of processes simultaneously, while reducing press load to be applied is necessary to avoid the problem of defective products or damage to dies due to overload in automatic load control device for use in an automatic press of the noted type is proposed, in which the presence of material to be press-worked in each die is detected to appropriately establish an optimum press load value.

3 Claims, 4 Drawing Sheets

LOAD CONTROL DEVICE FOR USE IN AUTOMATIC FORGING PRESS

BACKGROUND OF THE INVENTION

1. Field of the invention

The present invention relates to an automatic forging press and, more particularly, to a press for continuously carrying out a plurality of forging processes at a time.

2. Prior art

A generally known automatic forging press comprises a forging device in which a plurality of upper dies are mounted in a row on the bottom side of a slide hanging from an eccentric through a connecting rod so as to freely move up and down, while corresponding lower dies are mounted in a row on the upper side of a bed facing the upper dies, and a transfer device in which materials to be worked are supplied and fed to each die for each step sequentially in order. Finally, press-worked products are taken out from the forging press.

In the press of the above type, a large amount of deformation as well as complicated and accurate configuration never attained by a single forging press can be achieved, because heated materials to be press-worked are supplied from one side, the materials being subject to several processes of plastic deformations by application of pressure, and finally press-worked products are taken out from the other side.

When forging is repeatedly carried out for a long period of time, forging conditions may vary with the lapse of time, and therefore various attempts have been proposed to correct the varied forging conditions thereby securing uniform quality of products at all times.

Prior art disclosed from the foregoing viewpoint can be classified as follows:

1. Art for maintaining a load, applied by dies, constant:

For example, the Japanese Laid-Open Patent Publication (unexamined) No. 61-259900 discloses control of the pressing force applied to materials to be press-worked by arranging an elastic block on the upper side of the upper dies. Other Japanese Laid-Open Patent Publications (unexamined) Nos. 60-102300, 60-12300 also disclose similar presses.

2. Art for maintaining dead point center constant:

For example, the Japanese Laid-Open Utility Model Publication (unexamined) No.60-157097 discloses a press in which the temperature of the die sets 15*a*, 16*a* is detected, thereby actuating the slide control motor 43 with the programable controller 44, as shown in FIG. 4 thereof. Other Japanese Laid-Open Patent Publications (unexamined) Nos. 61-169199, 61-169200 and 60-141399 also disclose similar presses.

3. Art for freely performing vertical slide control:

For example, the Japanese Laid-Open Utility Model Publication (examined) discloses a press in which the wrist pin 5*b* is eccentrically and rotatably mounted on the top end of the connecting rod 3*b*, and one end of the lever 6*b* is connected to the wrist pin, while the other end thereof is provided with the adjusting screw 45.

The foregoing prior forging press control means with their respective features are advantageous to overcome the problems pointed out therein.

However, there still remains a problem not solved by the foregoing prior art presses particularly in the automatic press for continuously carrying out a plurality of processes at a time.

In the automatic press of this type, a required press load is separately determined depending on how many dies of all the dies are fed with materials to be press-worked at a certain point of time. For example, a required load when all of the plural dies is fed with the material mounts to five times as large as a required load when only one die is fed with the material.

Usually, automatic forging presses are operated to carry out continous forging press working by establishing their required load on the assumption that each of the plural dies are fully supplied with one material to be press-worked.

Because it is impossible to feed every die for every process with material, intermediate product or finally press-worked product (hereinafter collectively referred to as "workpiece") so long as the time of starting operation and the time of terminating thereof are concerned, a problem exists in that a smaller number of workpieces at those times of starting and/or terminating operation cannot avoid suffering from an excessive load, which results in defective products having such a defect as reduction in thickness or the like. The same kind of problem will arise also during operation caused by overheating of the workpiece itself which brings about failure of the feeding device resulting in interruption of continuous feeding with workpieces.

SUMMARY OF THE INVENTION

The present invention solves the above-discussed problems peculiar to the continuous automatic forging press working which have not as yet been overcome satisfactorily by the prior art, and has an object of providing a novel load control device for use in an automatic forging press.

In order to accomplish the above object, the load control device for use in an automatic forging press in accordance with the invention comprises detecting means which detect actual distribution of workpieces in a transfer device, arithmetic control means which compare the actual distribution with preliminarily stored distribution conditions and output a signal when required, and actuating means which receive the signal and move the bottom dead point of a slide by a required amount.

It is preferred, as a specific aspect of the load control device, that the movement of the bottom dead point is carried out by an arrangement comprising a connecting rod from which two legs extend downwardly, a wrist pin which is inserted in the two legs in parallel to the connecting rod and supported rotatably on a slide, and an adjustment lever which is eccentric and rotatably mounted on the wrist pin in such a manner as to be rotated and held at its position by the actuating means.

It is also preferred that rotation and holding of the adjustment lever is achieved by a balanced pressure between two hydraulic cylinders each mounted on an end of an actuating lever which is inserted in a link pin, the actuating lever crossing an upper part of the adjustment lever in its axial direction while retraining the upper part, and the actuating means comprises an electromagnetic change-over valve operated according to the signal from the arithmetic control means associated with a hydraulic pump.

In the transfer device, a supplied workpiece is picked up by being held between two feeding beams and placed on the first lower die to be subject to the first process of press working. After completing the first process, the workpiece (intemediate product) is removed from the first die by being picked up and then delivered to the next lower die. At the same time, another workpiece is simultaneously fed to the first lower die.

Distribution of the workpieces (including material, intermediate product and finally press-worked product) in every die is fully detected at every moment by the detecting means and detected information is sent to the arithmetic control means.

A required load applied to the dies for a multiprocess, simultaneous press, varies to a great deal depending upon whether a workpiece, to be subject to press working, is present at each die (i.e., whether each die is fed with a workpiece or not), as mentioned above. For example, assuming that a required process consists of three steps A, B and C, a relation between the presence of a workpiece and press load can be calculated as is shown in the following Table 1:

TABLE 1

| Pattern | Presence of Workpiece | | | Load (ton) |
|---|---|---|---|---|
| | Process A | Process B | Process C | |
| 1 | No | No | No | 0 |
| 2 | Yes | No | No | 500 |
| 3 | Yes | Yes | No | 1500 |
| 4 | Yes | Yes | Yes | 2300 |
| 5 | No | Yes | Yes | 1800 |
| 6 | No | No | Yes | 800 |
| 7 | Yes | No | Yes | 1300 |

In effect, for the purpose of achieving an appropriate load for each pattern as shown in the above table, it was found that a press load is proportional to an amount of movement of the slide required for plastic deformation of workpieces (including an amount of play), and that the amount of slide movement is proportional to an amount of slide adjustment. Accordingly, the characteristic of the invention consists in that the bottom dead point is moved up and down by instantaneously carrying out the slide adjustment for each pattern.

Table 2 shows the amounts of slide movement to give variation to each of the aforementioned patterns and corresponding die height values to be set which can be easily calculated from such amounts.

TABLE 2

| Pattern | Amount of Slide movement | Die height value to be set (mm) |
|---|---|---|
| 1 | 0.0 | 1000.0 |
| 2 | 0.5 | 999.5 |
| 3 | 1.5 | 998.5 |
| 4 | 2.3 | 997.7 |
| 5 | 1.8 | 998.2 |
| 6 | 0.8 | 999.2 |
| 7 | 1.3 | 998.7 |

The amount of slide movement for each pattern is preliminarily stored in an arithmetic control means as a reference value, the amount can be compared with an actually detected amount of each pattern, whereby a signal for commanding a required correction of the amount is output so that the actuating means may continue its operation until the detected amount coincides with the set value of die height H.

For example, when a distribution is detected by the detecting means such that a workpiece is present at the above process A, a workpiece is present at step B and no workpiece is present at step C in the foregoing Table 1, it indicates the pattern 3 in which the required press load is 1500 tons. Accordingly, when setting the die height to 998.5 mm, the amount of slide movement is 1.5 mm, and when applying press working to the workpieces at steps A and B, the press load is 1500 tons, thus a desirable configuration is achieved.

As a result of constructing the load control device for use in an automatic forging press in accordance with the invention as mentioned above, no defective products are provided, even when feeding interruptions of the workpiece occur throughout the entire press working from the start of the press working operation up to the end thereof. Instead products of uniform dimensions and shape can be obtained. Thus the above-discussed problems are fully solved by the invention.

Furthermore, the invention exhibits several secondary advantages as follows. For example, referring to Tables 1 and 2, when comparing the pattern 1, wherein no workpiece is fed to every process with the pattern 4, wherein every process is filled with a workpiece, the required amount of slide movement is 2.3 mm. Accordingly, when setting a minimum gap between the upper and lower dies to less than 2.3 mm, there is a possibility of butting between the upper and lower dies resulting in breakage or damage thereof. Because the amount of slide movement is a value to be established based on the rigidity of the press, it has been heretofore considered that the value is peculiar to each individual press. As a result, press dies applicable thereto have been limited. Now, by the application of the invention, no gap is needed between the upper and lower dies, and it is possible to design dies whose amount of slide movement is zero (i.e., ignoring such amount) resulting in a simple design.

Since the amount of slide movement can be ignored in the design, rigidity, which is a factor for deciding such amount, can be smaller than the conventional presses. In other words, the entire press can be small-sized, which results in a great economical advantage.

As the thickness of flashes can be smaller, the weight and quantity of material can be correspondingly reduced.

When attaching to the press some old dies whose amount of wear was corrected, it has been conventionally required to carry out adjustments with a liner or the like for the purpose of conforming the die height between such corrected die and the other, not corrected, die. Now, in the control device for use in an automatic forging press according to the invention, corrected die height values can be preliminarily input to the arithmetic control means, and no troublesome adjustment is required, which results in improvement of productivity.

Other objects and advantages of the invention will become apparent in the course of the following description with reference to the accompanying drawings.

DESCRIPTION OF THE PREFERRED EMBODIMENT

Figure 1:
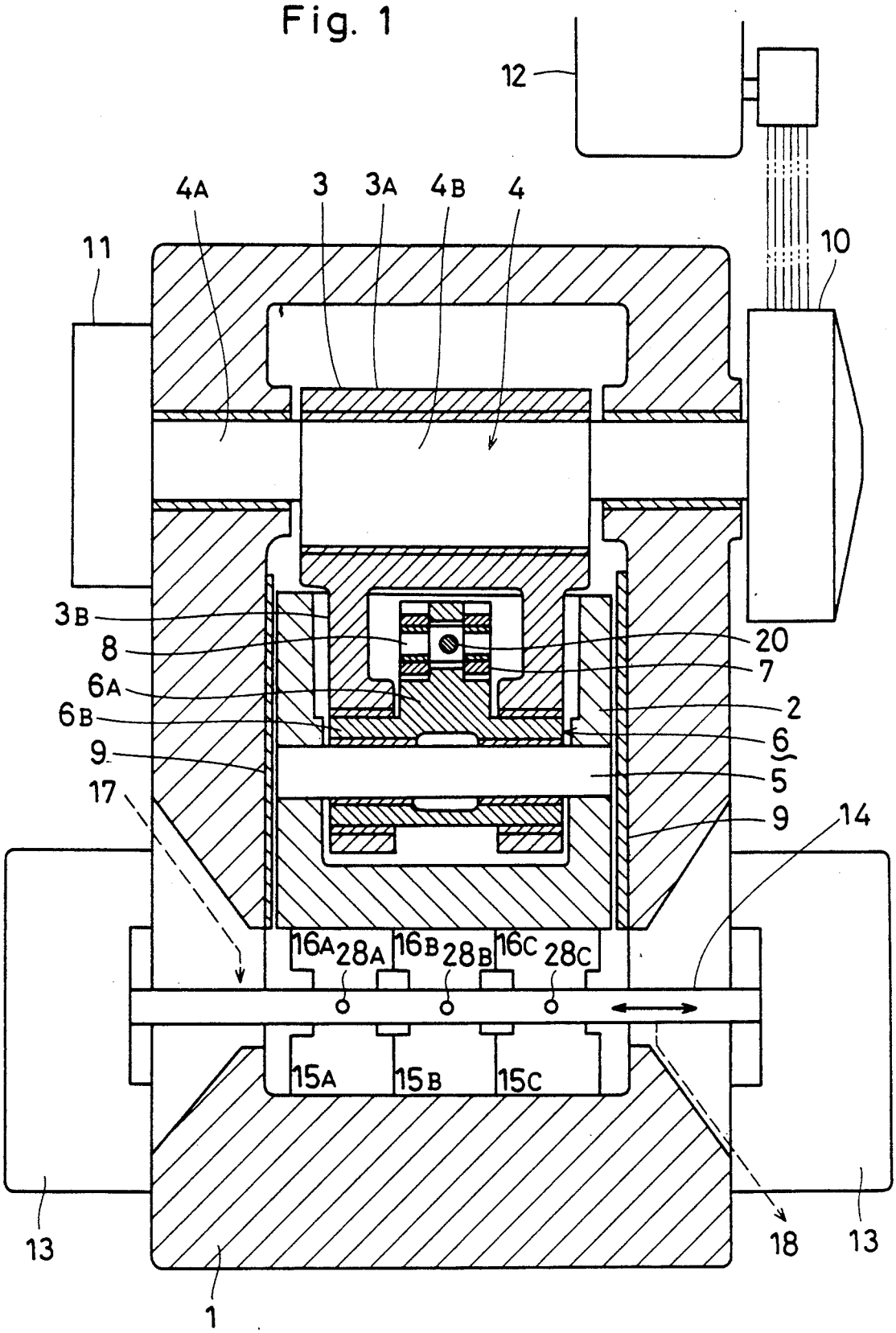
FIG. 1 is a partial sectional front view of an embodiment in accordance with the present invention.

An embodiment in accordance with the present invention is now described hereinafter with reference to the accompanying drawings.

A crankshaft 4 is inserted in the upper part of a bed 1, and a brake 11 is connected to one end of the crankshaft 4 while connecting a clutch 10 to the other end. The clutch 10 is driven by a main motor 12.

The crankshaft 4 comprises a coaxial shaft 4A and an eccentric shaft 4B inserted in a connecting rod 3.

Two legs 3B extend downwardly from a cylindrical part 3A of the connecting rod 3, and a wrist pin 5 is inserted through the two legs 3B in parallel to the connecting rod 3 and also through a slide 2, and is rotatably supported. An adjustment lever 6 is eccentrically mounted on the wrist pin 5 so as to be freely rotatable.

The main motor 12 drives the crankshaft 4 rotationally through the clutch 10, thereby the eccentric shaft 4B being eccentrically rotated. The connecting rod 3 with the eccentric shaft 4B inserted therein is oscillated, and the slide 2 connected to the wrist pin 5 moves up and down while being held by a guide plate 9.

Figure 2:
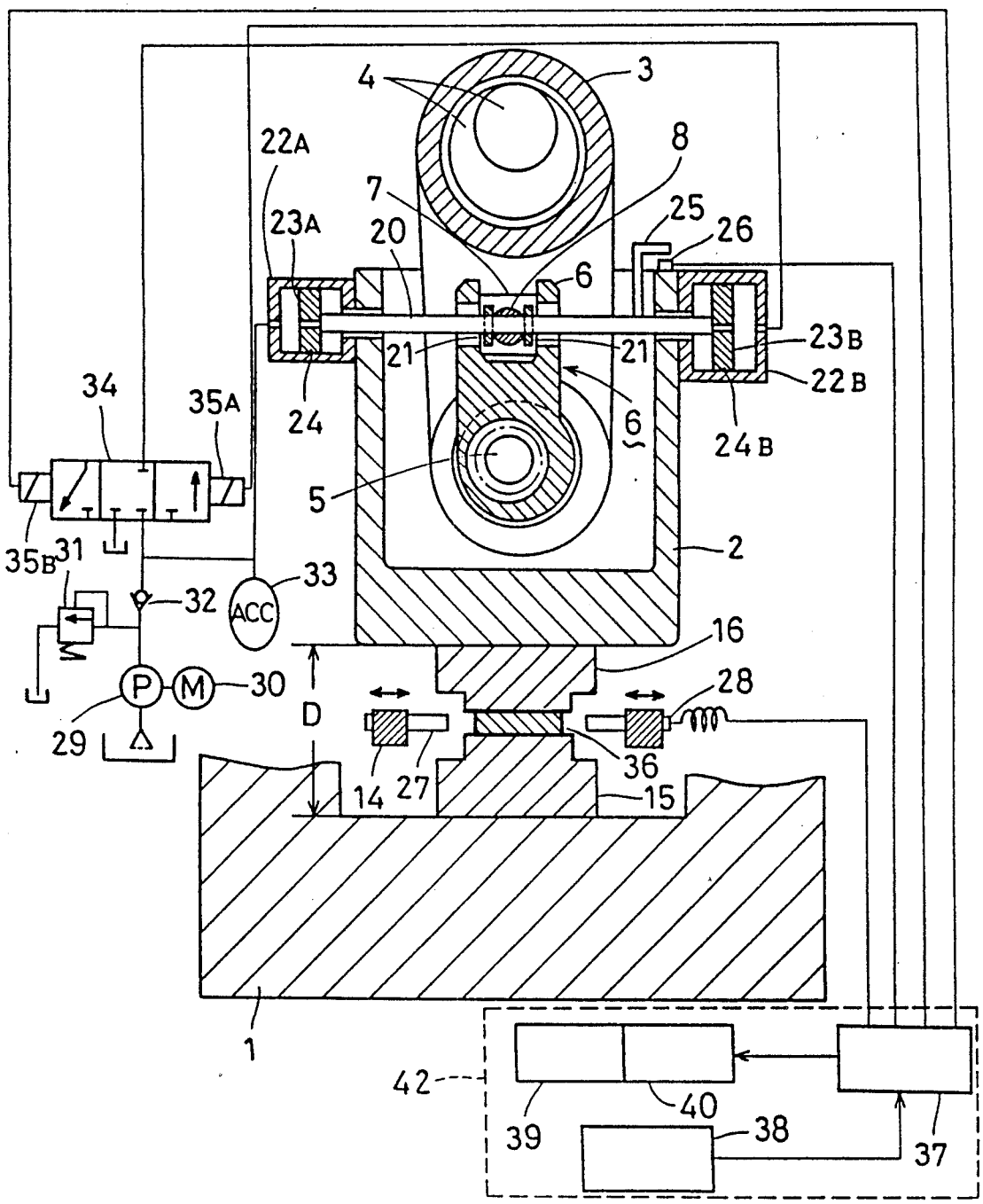
FIG. 2 is a partial sectional side view thereof.
Figure 3:
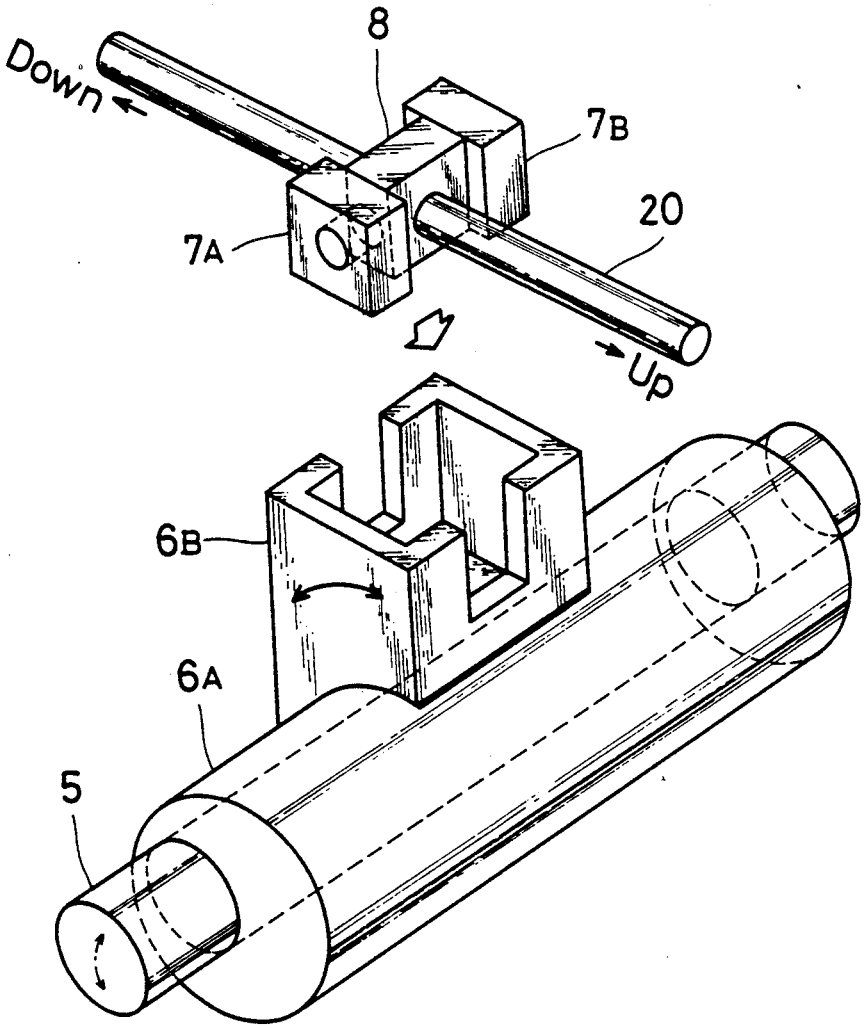
FIG. 3 is an exploded perspective view illustrating a part (including the adjustment lever, etc.) of the embodiment.
Figure 4:
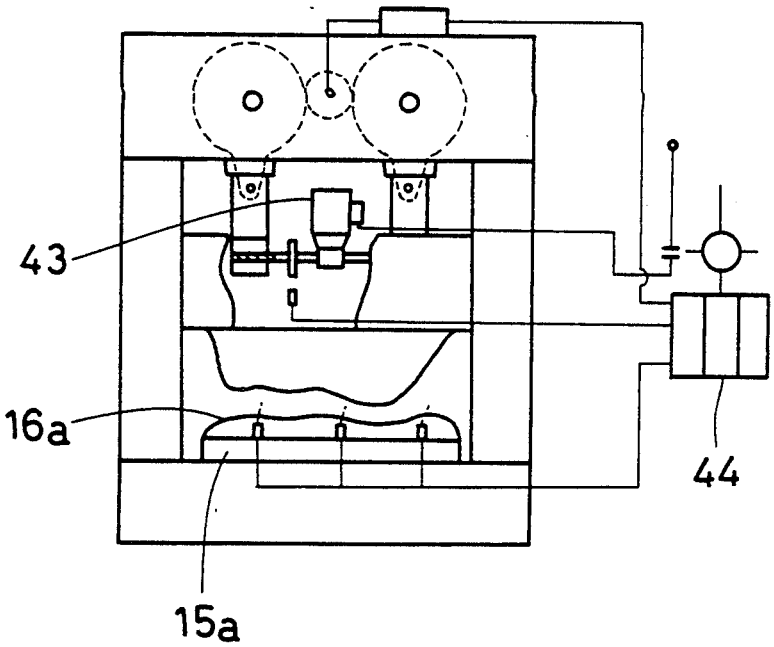
FIGS. 4 and 5 are front views illustrating different prior known presses.
Figure 5:
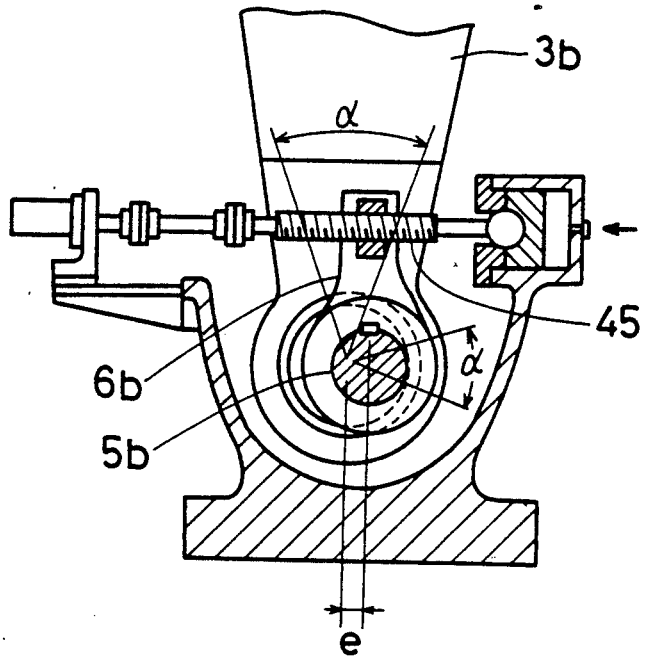

In FIG. 3, which shows a perspective view of the adjustment lever 6, a partially cut out box-shaped bearing section 6B is projectingly provided above a cylindrical part 6A through which the wrist pin 5 is inserted. Two square-shaped sliders 7A, 7B are slidably fitted in the bearing section 6B, the two sliders 7A, 7B being linked through a link pin 8. An actuating lever 20 is provided through the center of the link pin 8 making a right angle with the wrist pin 5 and fixed to the wrist pin 5 with fixing members 21 (FIG. 2).

One end of the actuating lever 20 is connected to a piston 23A which moves slidably together with a paking 24A within a small cylinder 22A mounted on the front section of the slide. The other end of the actuating lever 20 is connected to a piston 23B which moves slidably together with a packing 24B within a large cylinder 22B mounted on the rear section of the slide.

When applying an equal hydraulic pressure to the two cylinders 22A, 22B by actuating a coil 35A of an electromagnetic change-over valve 34, a force produced in the large cylinder 22B is larger due to the difference of area between the two pistons 23A, 23B, whereby the actuating lever 20 is moved leftward, i.e, the slide 2 is moved downward, thus the press load applied to a workpiece 36 is increased.

When the electromagnetic change-over valve 34 is actuated by the coil 35B, oil in the large cylinder 22B is discharged, thereby reducing the pressure. On the other hand, because a pressure from the hydraulic pump 29 is applied to the piston 23A in the small cylinder 22A, the actuating lever 20 is moved rightward together with the piston 23A, i.e., the slide 2 is moved upward, thus the press load applied to the workpiece 36 is reduced.

When the electromagnetic change-over valve 34 and the hydraulic pump 29 are standing, a hydraulic pressure accumulated in the accumulator 33 is applied to the piston 23A and balanced with the hydraulic pressure in the large cylinder 22B, whereby the actuating lever 20 is held and the adjustment lever 6 is not actuated.

When applying a press load to the slide 2, a force to rotate clockwise the adjustment lever 6 is generated and tries to move the actuating lever 20 rightward. However, because the oil in the large cylinder 22B is closed, the piston 23B is not actuated. Accordingly, neither the actuating lever 20 nor the adjustment lever 6 is actuated, thus the press load does not vary.

The amount of actuation by the adjustment lever 6 is detected by the detector section 26 attached to the slide 2. Following the detection signal output as a result of such detection, the arithmetic control section 42 displays a set value 39 and an actual value 40 of the die height D.

This embodiment shows an automatic forging press of three process type provided with three lower dies 15A, 15B, 15C on the bed of the frame 1 and three upper dies 16A, 16B, 16C at the bottom of the slide 2. Each process is hereinafter referred to as process A, Process B and Process C, respectively.

Two transfer beams 14 are provided, one at the front part and the other at the rear part of the dies, and the workpieces 36 are fed in order by the driving unit 13. More specifically, the two beams 14, come near the workpiece piece 36 during process A, pick the workpiece 36 up with clamps 27 by holding it therebetween to deliver it to the next process B. When reaching the process B, the clamp 27 release the workpiece 36 and place it on the lower die 15B, then return to their positions in process A. At this time, the slide 2 and the upper dies 16 come down at a stroke and execute a press working. By repeating a series of such operations, automatic forging is carried out.

At the workpiece charging port 17, the transfer beams 14 are supplied with the workpiece (material) 36 which was cut into a suitable size and heated by a heater. At the workpiece discharging port 18, the press-worked workpiece 36 (product) is taken from the transfer beams 14 to outside the press. The transfer beams 14 are provided with three workpiece detectors 28A, 28B, 28C which detect the presence of a workpiece.

Detection signals from the workpiece detectors 28 are input to the arithmetic control section 42 so that an appropriate press load may be established by controlling the operation of the die height adjusting drive mechanism, as described above.

Die height can be appropriately controlled in accordance with the temperature change of the press frame and dies by storing preliminarily in the arithmetic control section 42 a prescribed amount of variation in die height due to thermal expansion of the press frame and dies. Thus, products of uniform shape and size can be obtained from starting of the press working operation to the ending thereof by performing the appropriate press load control described so far.

Having described a specific embodiment of the load control device for use in automatic forging press in accordance with the present invention, it is believed obvious that modification and variation of the invention is possible in the light of the above teachings.

What is claimed is:

1. A load control device for use in an automatic forging press, comprising:

a forging device including a slide, a bed, a plurality of upper dies mounted in a row on a bottom side of said slide, and a plurality of lower dies mounted in a row on an upper side of said bed facing said upper dies, means for reciprocating said slide so as to move said slide to a slide position where said upper dies and lower dies press work material therebetween;

a transfer device for supplying material to be press-worked to each die, feeding the material to successive dies for processing by said successive dies, and for withdrawing the finally press-worked material from the dies;

arithmetic control means;

detecting means for detecting the distribution of forging products in said transfer device and providing a signal representative thereof of said arithmetic control means, said arithmetic control means comparing said distribution with a preliminarily stored specific distribution condition and generating an output signal indicative of said comparison; and actuating means for receiving said output signal and displacing said slide to vary said slide position based upon the detected distribution of workpieces within said transfer device accordingly.

2. The load control device according to claim 1, wherein said means for reciprocating said slide includes: a connecting rod from which two legs extend downwardly; an eccentric shaft extending through said connecting rod; a wrist pin extending through said legs in a direction parallel to said connecting rod, said wrist pin being supported rotatably on said slide; and an eccentric adjustment lever rotatably mounted on said wrist pin in such a manner as to be rotated and held at a selected position by said actuating means.

3. The load control device according to claim 2, wherein said means for reciprocating said slide further includes: a link pin; an actuating lever inserted in said link pin; two hydraulic cylinders each mounted on an end of said actuating lever; and a hydraulic pump, said actuating lever crossing an upper part of the adjustment lever in the axial direction while retaining the upper part, and said actuating means comprising an electromagnetic change-over valve operated by the output signal from said arithmetic control means in association with said hydraulic pump, wherein turning and holding of said adjustment lever is achieved by a balanced pressure between the two hydraulic cylinders.

* * * * *